US012480373B2

(12) United States Patent
Greci et al.

(10) Patent No.: US 12,480,373 B2
(45) Date of Patent: Nov. 25, 2025

(54) ACTUATING A DOWNHOLE DEVICE WITH A REACTIVE METAL

(71) Applicant: Halliburton Energy Services, Inc., Houston, TX (US)

(72) Inventors: Stephen Michael Greci, Little Elm, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/683,098

(22) Filed: Nov. 13, 2019

(65) Prior Publication Data

US 2021/0140255 A1 May 13, 2021

(51) Int. Cl.

| | |
|---|---|
| ***E21B 23/04*** | (2006.01) |
| ***E21B 23/06*** | (2006.01) |
| ***E21B 33/12*** | (2006.01) |
| ***E21B 34/14*** | (2006.01) |

(52) U.S. Cl.

CPC ..... *E21B 23/04* (2013.01); *E21B 23/065* (2013.01); *E21B 33/12* (2013.01); *E21B 34/14* (2013.01); *E21B 2200/06* (2020.05)

(58) Field of Classification Search

CPC ..... E21B 23/04; E21B 23/065; E21B 33/12; E21B 34/14; E21B 2200/06

See application file for complete search history.

(56) References Cited

U.S. PATENT DOCUMENTS

| | | | |
|---|---|---|---|
| 1,982,569 | A | 11/1934 | Byrd |
| 3,018,830 | A | 1/1962 | Springer |
| 3,046,601 | A | 7/1962 | Hubbert et al. |
| 3,175,618 | A | 3/1965 | Lang et al. |
| 3,385,367 | A | 5/1968 | Kollsman |
| 3,993,577 | A | 11/1976 | Black |
| 4,445,694 | A | 5/1984 | Flaherty |
| 4,612,985 | A | 9/1986 | Rubbo et al. |
| 4,846,278 | A | 7/1989 | Robbins |
| 5,070,942 | A | 12/1991 | McInnes |

(Continued)

FOREIGN PATENT DOCUMENTS

| | | | |
|---|---|---|---|
| CA | 2751473 | A1 | 8/2010 |
| CA | 2751473 | C | 9/2014 |

(Continued)

OTHER PUBLICATIONS

International Search Report and Written Opinion for corresponding International Patent Application No. PCT/US2019/062225, dated Aug. 11, 2020.

(Continued)

*Primary Examiner* — Crystal J. Lee
(74) *Attorney, Agent, or Firm* — The Hilton Firm PLLC

(57) ABSTRACT

Methods for actuating a downhole device in a wellbore. An example of the method is positioning a downhole device in a wellbore, the downhole device comprising a reactive metal and a reaction-inducing fluid; wherein the reaction-inducing fluid is isolated from the reactive metal. The method further includes removing the isolation of the reactive metal such that it reacts with the reaction-inducing fluid to generate a hydrogen gas, and actuating the downhole device with the hydrogen gas.

20 Claims, 8 Drawing Sheets

(56) References Cited

U.S. PATENT DOCUMENTS 5,139,235 A 8/1992 Kilmer
5,163,321 A 11/1992 Perales
5,803,177 A 9/1998 Hriscu et al.
6,050,336 A 4/2000 Willauer et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 * 9/2009 Xu ..... E21B 23/065 166/321
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,086,000 B2 12/2011 Weijers et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,702,029 B2 7/2017 Fripp
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0074740 A1 6/2002 Quoiani
2002/0125008 A1 9/2002 Wetzel et al.
2003/0150614 A1 8/2003 Brown et al.
2003/0159829 A1 * 8/2003 Fripp ..... E21B 34/06 166/383
2004/0118572 A1 6/2004 Whanger et al.
2004/0149418 A1 8/2004 Bosma et al.
2004/0173361 A1 9/2004 Lohbeck
2004/0244994 A1 12/2004 Jackson
2005/0039927 A1 2/2005 Wetzel et al.
2005/0092485 A1 5/2005 Brezinski
2005/0171248 A1 8/2005 Li et al.
2005/0199401 A1 9/2005 Patel et al.
2005/0257961 A1 11/2005 Snell et al.
2006/0039927 A1 2/2006 Aoki et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0221374 A1 9/2007 Filippov et al.
2007/0257405 A1 11/2007 Freyer
2008/0066931 A1 3/2008 Xu
2008/0099209 A1 5/2008 Loretz et al.
2008/0142214 A1 6/2008 Keller
2008/0149351 A1 6/2008 Marya et al.
2008/0185150 A1 8/2008 Brown
2008/0185158 A1 8/2008 Chalker et al.
2008/0194717 A1 8/2008 Vaidya et al.
2008/0220991 A1 9/2008 Slay et al.
2008/0251250 A1 10/2008 Brezinski et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0147535 A1 6/2010 Gorrara et al.
2010/0163252 A1 7/2010 Regnault De La Mothe et al.
2010/0212891 A1 8/2010 Stewart et al.
2010/0243276 A1 9/2010 King et al.
2010/0270031 A1 10/2010 Patel
2010/0307770 A1 12/2010 Sponchia et al.
2011/0042081 A1 2/2011 Streich et al.
2011/0073310 A1 3/2011 Clemens
2011/0098202 A1 4/2011 James et al.
2011/0174504 A1 * 7/2011 Wright ..... E21B 49/081 166/386
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0125630 A1 5/2012 Sevre
2012/0132427 A1 5/2012 Renshaw et al.
2012/0175134 A1 7/2012 Robisson et al.
2012/0205091 A1 8/2012 Turley
2012/0205092 A1 8/2012 Givens et al.
2012/0272546 A1 11/2012 Tsai
2012/0292013 A1 * 11/2012 Munshi ..... E21B 33/127 166/120
2012/0292023 A1 11/2012 Hinkie et al.
2012/0318513 A1 12/2012 Mazyar et al.
2013/0056196 A1 3/2013 Hench
2013/0056207 A1 3/2013 Wood et al.
2013/0056209 A1 3/2013 Mazyar et al.
2013/0056227 A1 3/2013 Sponchia
2013/0056228 A1 3/2013 Gruetzmann et al.
2013/0146312 A1 6/2013 Gerrard et al.
2013/0213032 A1 * 8/2013 Xu et al. ..... E21B 41/00 60/527
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0311741 A1 10/2014 Tunget
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0233215 A1 8/2015 Yeh et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Droger et al.
2015/0369027 A1 12/2015 Jones et al.
2016/0032696 A1 2/2016 Caccialupi et al.
2016/0047177 A1 2/2016 Martin et al.

(56) References Cited

U.S. PATENT DOCUMENTS

| | | | |
|---|---|---|---|
| 2016/0097252 | A1 | 4/2016 | Resink |
| 2016/0137912 | A1 | 5/2016 | Sherman et al. |
| 2016/0138359 | A1 | 5/2016 | Zhao et al. |
| 2016/0145965 | A1 | 5/2016 | Zhao et al. |
| 2016/0194933 | A1 | 7/2016 | O'Brien et al. |
| 2016/0201425 | A1 | 7/2016 | Walton et al. |
| 2016/0215604 | A1 | 7/2016 | Potapenko |
| 2016/0230495 | A1 | 8/2016 | Mazyar et al. |
| 2016/0273299 | A1 | 9/2016 | Fripp et al. |
| 2016/0312586 | A1 | 10/2016 | De Clute-Melancon |
| 2016/0319633 | A1 | 11/2016 | Cooper et al. |
| 2016/0326829 | A1 | 11/2016 | Dolog et al. |
| 2016/0326830 | A1 | 11/2016 | Hallundbæk et al. |
| 2016/0376869 | A1 | 12/2016 | Rochen et al. |
| 2016/0376870 | A1 | 12/2016 | Roselier et al. |
| 2017/0122062 | A1 | 5/2017 | Freyer |
| 2017/0191343 | A1 | 7/2017 | Solhaug |
| 2017/0234103 | A1 | 8/2017 | Frazier |
| 2017/0261137 | A1 | 9/2017 | Williams et al. |
| 2017/0335673 | A1 | 11/2017 | Burke et al. |
| 2018/0078998 | A1 | 3/2018 | Sherman |
| 2018/0085154 | A1 | 3/2018 | Kulper et al. |
| 2018/0087346 | A1 | 3/2018 | Rochen |
| 2018/0087350 | A1 | 3/2018 | Sherman |
| 2018/0094492 | A1 | 4/2018 | Knapp et al. |
| 2018/0202271 | A1 | 7/2018 | Semple et al. |
| 2018/0216431 | A1 | 8/2018 | Walton, III et al. |
| 2018/0230772 | A1 | 8/2018 | Brandsdal et al. |
| 2018/0245420 | A1 | 8/2018 | Ringgenberg |
| 2018/0266215 | A1* | 9/2018 | Fagley, IV ..... E21B 23/06 |
| 2018/0320472 | A1 | 11/2018 | Fripp |
| 2018/0355691 | A1 | 12/2018 | Andersen |
| 2018/0355693 | A1 | 12/2018 | Al-AbdulJabbar et al. |
| 2018/0362415 | A1 | 12/2018 | Doud et al. |
| 2019/0017285 | A1 | 1/2019 | Kain |
| 2019/0040721 | A1 | 2/2019 | Kohn et al. |
| 2019/0048673 | A1 | 2/2019 | Knight et al. |
| 2019/0048680 | A1 | 2/2019 | Stein et al. |
| 2019/0055808 | A1 | 2/2019 | Krueger |
| 2019/0055839 | A1 | 2/2019 | Skillingstad et al. |
| 2019/0128074 | A1 | 5/2019 | Stokes et al. |
| 2019/0153852 | A1 | 5/2019 | Lallemand et al. |
| 2019/0203101 | A1 | 7/2019 | Dusterhoft et al. |
| 2019/0249509 | A1 | 8/2019 | Jakkula et al. |
| 2019/0264543 | A1 | 8/2019 | Sherman |
| 2019/0316025 | A1 | 10/2019 | Sherman et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0032980 | A1 | 2/2021 | Fripp et al. |
| 2021/0040810 | A1 | 2/2021 | Evers |
| 2021/0079756 | A1 | 3/2021 | Ornelaz et al. |
| 2021/0115750 | A1 | 4/2021 | Fripp et al. |
| 2021/0140255 | A1 | 5/2021 | Greci et al. |
| 2021/0189817 | A1 | 6/2021 | Fripp et al. |
| 2021/0230982 | A1 | 7/2021 | Bogardus et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |
| 2024/0191605 | A1 | 6/2024 | Newton |

FOREIGN PATENT DOCUMENTS

| | | | |
|---|---|---|---|
| CA | 3085547 | A1 | 8/2019 |
| CN | 1708631 | A | 12/2005 |
| CN | 102027189 | A | 4/2011 |
| CN | 104583530 | A | 4/2015 |
| CN | 105121777 | B | 12/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| DE | 323840 | C | 8/1920 |
| DE | 323842 | C | 8/1920 |
| EP | 1067320 | A2 | 1/2001 |
| EP | 2399000 | A2 | 12/2011 |
| EP | 2466064 | A1 | 6/2012 |
| EP | 2217790 | B1 | 10/2016 |
| EP | 2753791 | B1 | 6/2017 |
| FR | 3073549 | A1 | 5/2019 |
| GB | 2381278 | A | 4/2003 |
| GB | 2416796 | A | 2/2006 |
| GB | 2469723 | A | 10/2010 |
| GB | 2514195 | B | 6/2019 |
| GB | 2583232 | A | 10/2020 |
| GB | 2557397 | B | 8/2021 |
| GB | 2600258 | | 4/2022 |
| MX | 2011008597 | A | 9/2011 |
| PL | 426008 | A1 | 1/2019 |
| PL | 430499 | A1 | 7/2020 |
| RU | 2424419 | C1 | 7/2011 |
| RU | 2588501 | C2 | 6/2016 |
| RU | 182236 | U1 | 8/2018 |
| WO | 0026501 | A1 | 5/2000 |
| WO | 03-004819 | A2 | 1/2003 |
| WO | 2008079486 | A1 | 7/2008 |
| WO | 2010096417 | A2 | 8/2010 |
| WO | 2012090056 | A2 | 7/2012 |
| WO | 2013033208 | | 3/2013 |
| WO | 2014098885 | A1 | 6/2014 |
| WO | 2014110382 | A1 | 7/2014 |
| WO | 2014210283 | A1 | 12/2014 |
| WO | 2016081287 | A1 | 5/2016 |
| WO | 2016171666 | A1 | 10/2016 |
| WO | 2018005740 | A1 | 1/2018 |
| WO | 2018057361 | A1 | 3/2018 |
| WO | 2018085102 | A1 | 5/2018 |
| WO | 2018102196 | A1 | 6/2018 |
| WO | 2018147833 | A1 | 8/2018 |
| WO | 2019094044 | | 5/2019 |
| WO | 2019147285 | A1 | 8/2019 |
| WO | 2019164492 | A1 | 8/2019 |
| WO | 2019164499 | A1 | 8/2019 |
| WO | 2020005252 | | 1/2020 |
| WO | 2020018110 | A1 | 1/2020 |
| WO | 2020068037 | A1 | 4/2020 |
| WO | 2021011013 | A1 | 1/2021 |
| WO | 2021021203 | A1 | 2/2021 |
| WO | 2021034325 | A1 | 2/2021 |
| WO | 2021076141 | A1 | 4/2021 |
| WO | 2021173161 | A1 | 9/2021 |

OTHER PUBLICATIONS

International Search Report and Written Opinion dated Aug. 2, 2018, International PCT Application No. PCT/US2017/061307.

Search Report in FR Application No. 1859379, dated Oct. 15, 2019.

International Search Report and Written Opinion dated Nov. 19, 2018; International PCT Application No. PCT/US2018/019337.

Denmark Examination Report and Search Report dated Mar. 16, 2021, Denmark Application No. PA202070389.

International Search Report and Written Opinion dated Jul. 8, 2020, issued in related International Application No. PCT/US2019/056814.

International Search Report and Written Opinion for corresponding PCT International Application No. PCT/US2019/068497; dated Sep. 17, 2020.

International Search report and Written Opinion issued in related PCT/US2019/068493 dated Sep. 15, 2020.

NEMISIS Annulus Swellable Packer, Weatherford, Swellable Products, 2009-2011.

International Search Report and Written Opinion dated Nov. 22, 2019; International PCT Application No. PCT/US2019/019210.

International Search Report and Witten Opinion dated May 20, 2020, issued in related PCT/US2019/047529.

Tao, Solid expandable tubular patching technique for high-temperature and high-pressure casing damaged wells, Research Paper, Jun. 2015, pp. 408-409, Petroleum Exploration and Development, vol. 42, Issue 3.

(56) References Cited

OTHER PUBLICATIONS

Dutch Search Report issued in NL 2026726, dated Aug. 13, 2021.
International Search Report and Written Opinion dated Sep. 8, 2021 in PCT/US2020/066193.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated Jan. 18, 2022.
International Search Report & Written Opinion in PCT/US2020/065539, dated Aug. 30, 2021.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.
Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.
DK Examination Report in Application No. PA 202070389, dated Oct. 20, 2021.
International Preliminary Report on Patentability in PCT/US2019/068493, dated Jun. 30, 2022.
International Preliminary Report on Patentability in PCT/US2019/068497, dated Jun. 30, 2022.
International Preliminary Report on Patentability in PCT/US2019/019210, dated Aug. 24, 2021.
International Preliminary Report on Patentability in PCT/US2019/058904, dated May 3, 2022.
Fripp, Novel Expanding Metal Alloy for Non-Elastomeric Sealing and Anchoring, Research Paper, Oct. 3, 2022, 8 pages, Society of Petroleum Engineers, SPE-210273-MS.
International Search Report and Written Opinion dated Feb. 10, 2021; International Application No. PCT/US2020/034887.
International Preliminary Report on Patentability in PCT/US2019/056814, dated Apr. 19, 2022.
First Examination Report in SA Application No. 522441072 dated May 29, 2023.
Written Opinion and Search Report in SG Application No. 11202112174W, dated Jul. 24, 2023.
Examination Report in GB Application No. GB2205332.6 dated Sep. 7, 2023.
Search Report in NL Application No. 2032583, dated Aug. 31, 20223.
Office Action dated Nov. 17, 2023 for U.S. Appl. No. 16/964,430.
Ellison, et al. "Dielectric characterization of bentonite clay at various moisture contents and with mixtures of biomass in the microwave spectrum", Journal of Microwave Power and Electromagnetic Energy, 2018, vol. 52, No. 1, 3-15.
Ellison, et al. "Activated carbon supported Ni, Fe, and bimetallic NiFe catalysts for COx-free H2 production by microwave methane pyrolysis", International Journal of Hydrogen Energy, 55 (2024), 1062-1070.
International Search Report & Written Opinion in PCT/US2023/086272, mailed Sep. 12, 2024.
Ellison, et al. "Comparative evaluation of microwave and conventional gasification of different coal types: Experimental reaction studies", Fuel, 321 (2022), 124055, 10 pgs.
Examination Report mailed Jun. 27, 2024 in Canadian Patent Application No. 3,139,190.
Search Report mailed Feb. 28, 2024 in Polish Patent Application No. PL446825.
Written Opinion mailed Feb. 6, 2025 in Singaporean Patent Application No. 11202112174W.

* cited by examiner

ACTUATING A DOWNHOLE DEVICE WITH A REACTIVE METAL

TECHNICAL FIELD

The present disclosure relates to actuating a downhole device, and more particularly, to actuating a downhole device via pneumatic pressure provided by a gas produced from the reaction of a reactive metal and a reaction-inducing fluid.

BACKGROUND

The actuation of downhole devices (e.g., opening, closing, shifting, setting, etc.) is an important part of wellbore operations such as setting packers, opening/closing in-flow control devices, gravel pack bypasses, shifting or setting production sleeves, releasing an anchor, etc. Typically, wellbore personnel may intervene to actuate the downhole device. Intervention can extend operation time and increase overall operation expenses. Intervention-less methods of actuating downhole devices may be used to decrease operation expenses and increase productivity. Some intervention-less methods of actuating downhole devices may utilize hydraulic pressure actuation. Hydraulic pressure actuation requires a downhole fluid to achieve a fluid pressure exceeding the threshold pressure necessary for actuation. Hydraulic pressure actuation also requires a downhole fluid to be directed to a desired location. In some wellbore operations, fluid properties such as composition and pressure may not be known which may create uncertainty with regards to utilizing hydraulic pressure actuation.

The present disclosure provides improved apparatus and methods for actuating a downhole device in a wellbore.

BRIEF DESCRIPTION OF THE DRAWINGS

Illustrative examples of the present disclosure are described in detail below with reference to the attached drawing figures, which are incorporated by reference herein, and wherein.

Figure 1:
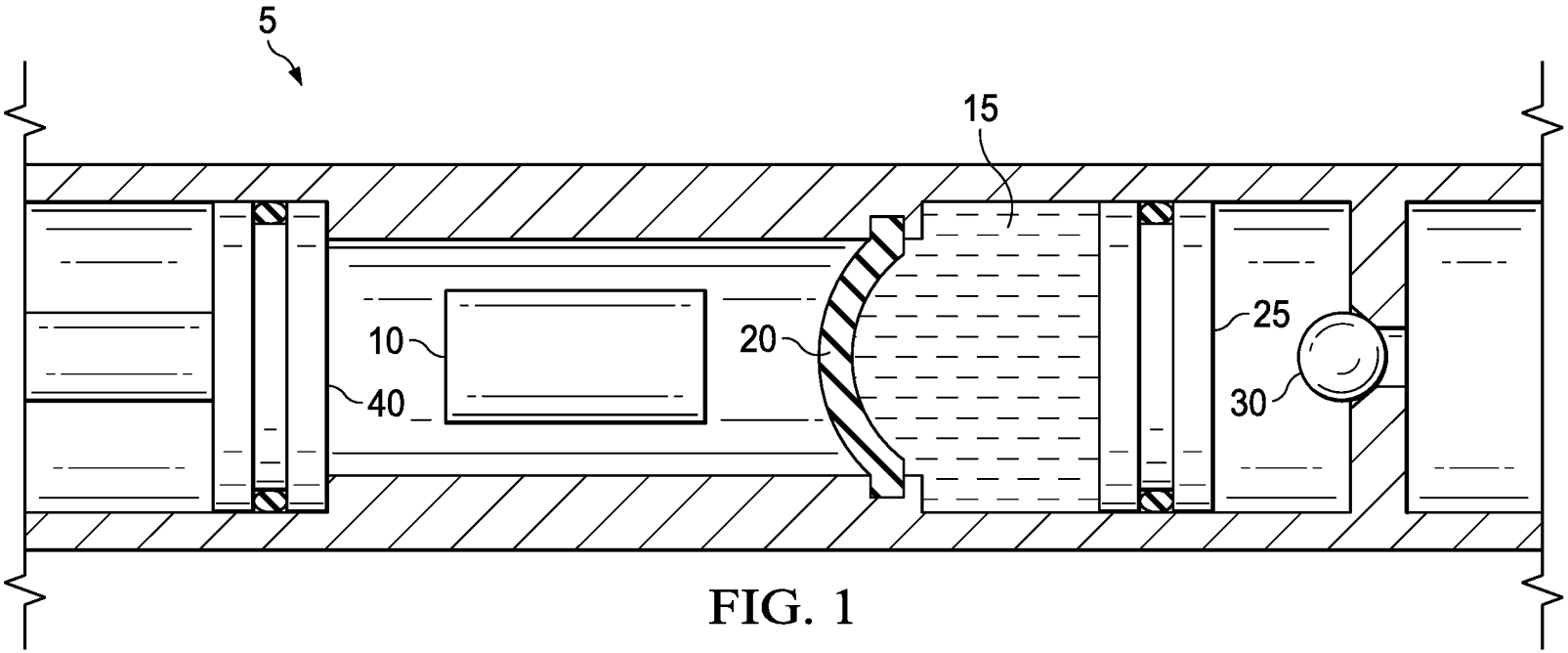
FIG. 1 is a cross-section view of an example downhole device in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to actuating a downhole device, and more particularly, to actuating a downhole device via pneumatic pressure provided by a gas produced from the reaction of a reactive metal and a reaction-inducing fluid.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of reactive metals to provide a pneumatic pressure sufficient for actuating a downhole device. The reactive metals chemically react with a specific reaction-inducing fluid to produce hydrogen gas and a metal hydroxide. The pneumatic pressure of the hydrogen gas increases as the reaction proceeds. When the pneumatic pressure exceeds a desired threshold, the downhole device may be actuated. Advantageously, the reactive metal may be used in a variety of wellbore applications where intervention-less actuation is desired. Yet a further advantage is that the reactive metal generates a volume of gas sufficient to provide the pneumatic pressure necessary for actuating the downhole device. An additional advantage is that the methods may be used for a variety of downhole devices including sleeves, gravel pack bypasses, packer setting tools, inflow control devices, anchor releases, etc. Another advantage is that the gas-producing reaction does not require oxygen. One other advantage is that the reaction-inducing fluid may be a brine either present in the subterranean formation or introduced at the surface in the downhole device.

The reactive metal undergoes a chemical reaction in the presence of a reaction-inducing fluid (e.g., a brine) to form a reaction product (e.g., hydrogen gas and metal hydroxide). Magnesium may be used to illustrate the reaction in equation 1 below:

$$Mg+2H_2O \rightarrow Mg(OH)_2+H_2 \quad \text{Eq. 1}$$

The hydrogen gas generated from the reaction may continue to be produced so long as the reactive metal is in contact with the reaction-inducing fluid. The reactive metal may comprise any metal or metal alloy that undergoes a chemical reaction to form a reaction product of a gas.

Examples of suitable metals for the reactive metal include, but are not limited to, magnesium, calcium, aluminum, zinc, iron, potassium, sodium, or any combination of reactive metals. Preferred metals include magnesium, calcium, and aluminum.

Examples of suitable metal alloys for the reactive metal include, but are not limited to, alloys of magnesium, calcium, aluminum, zinc, iron, potassium, sodium, or any combination of reactive metals and/or alloys. Preferred metal alloys include alloys of magnesium-zinc, magnesium-aluminum, or calcium-magnesium. In some examples, the metal alloys may comprise alloyed elements that are not metallic. Examples of these non-metallic elements include, but are not limited to, graphite, carbon, silicon, boron nitride, and the like. In some examples, the metal is alloyed to increase or decrease reactivity and/or to control the formation of oxides and hydroxides. In other examples, the metal is heat treated to control the size and shape of the oxides and hydroxides including precipitation hardening, quenching, and tempering.

In some examples, the metal alloy is also alloyed with a dopant metal that promotes corrosion or inhibits passivation and thus increases the rate of the gas and hydroxide formation. Examples of dopant metals include, but are not limited to, nickel, iron, copper, carbon, titanium, gallium, mercury, cobalt, iridium, gold, palladium, or any combination thereof. In another example, particles of the metal are coated with the dopant, and the coated metal powder is pressed and extruded to create the metal alloy.

The reactive metal may be provided in any shape sufficient for its purpose. The reactive metal may be formed in a solid solution process, a powder metallurgy process, or through any other method as would be apparent to one of ordinary skill in the art.

In some optional examples, the reactive metal may include a removable barrier coating. The removable barrier coating may be used to cover the exterior surfaces of the reactive metal and isolate the reactive metal to prevent contact with the reaction-inducing fluid. The removable barrier coating may be removed when the reaction is to occur. The removable barrier coating may be used to delay the reaction and/or prevent a premature reaction. Examples of the removable barrier coating include, but are not limited to, any species of plastic shell, elastomeric shell, organic shell, metallic shell, anodized shell, paint, dissolvable coatings (e.g., solid magnesium compounds), eutectic materials, or any combination thereof. When desired, the removable barrier coating may be removed from the reactive metal with any sufficient method. For example, the removable barrier coating may be removed through dissolution, a phase change induced by changing temperature, corrosion, hydrolysis, the degradation of the support of the barrier coating, or the removable barrier coating may be time-delayed and degrade after a desired time under specific wellbore conditions.

Generally, the reaction-inducing fluid induces a reaction in the reactive metal to form hydrogen gas. Examples of the reaction-inducing fluid include, but are not limited to, saltwater (e.g., water containing one or more salts dissolved therein), brine (e.g., saturated saltwater, which may be produced from subterranean formations), seawater, freshwater, or any combination thereof. Generally, the reaction-inducing fluid may be from any source provided that the fluid does not contain an excess of compounds that may undesirably affect other components in the downhole device. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. In some examples, the density of the reaction-inducing fluid may exceed 8.5 pounds per gallon. Advantageously, the reactive metal of the present disclosure may not be impacted by contact with high-salinity fluids. One of ordinary skill in the art, with the benefit of this disclosure, should be readily able to select a reaction-inducing fluid for inducing a reaction with the reactive metal.

In some optional examples, the reaction-inducing fluid may comprise an acid. The acid may be mixed with the general aqueous fluids described above, such as a brine. The acid may help maintain the reactive metal reactant in solution and may help accelerate the reaction. Examples of acids generally include any organic or inorganic acid. Specific examples of acids may include, but are not limited to, citric acid, hydrochloric acid, succinic acid, sulfamic acid, adipic acid, lactic acid, or any combination of acid. One of ordinary skill in the art, with the benefit of this disclosure, should be readily able to select an optional acid for use with the reaction-inducing fluid.

The reactive metal and the downhole device may be used in high-temperature formations, for example, in formations with zones having temperatures equal to or exceeding 350° F. Advantageously, the use of the reactive metal of the present disclosure may not be impacted in high-temperature formations. In some examples, the reactive metal may be used in both high-temperature formations and with high-salinity fluids. In a specific example, the reactive metal may react with a brine having a salinity of 10% or greater while also being disposed in a wellbore zone having a temperature equal to or exceeding 350° F. Additionally, oxygen is not necessary for the reaction to take place.

The downhole device may be any device that can be actuated by the pressurized gas produced from the reaction of the reactive metal and the reaction-inducing fluid. Examples of the downhole device include, but are not limited to, setting tools, inflow control devices, gravel pack bypasses, packers, annular casing packer, frac plug, bridge plug, production sleeves, injection sleeves, anchor releases such as anchor slips, etc. The downhole device may be any device comprising a mechanism that may be actuated by pneumatic pressure.

In some examples, the downhole device comprises an isolation barrier. The isolation barrier isolates the reactive metal from the reaction-inducing fluid until it is desired for the chemical reaction to commence. An example of the isolation barrier is the removable barrier coating described above. Another example of the isolation barrier is a rupture disk which may be ruptured at a specific applied pressure. Other examples of isolation barriers may be degradable materials which may degrade from chemical reactions or wellbore conditions at desired times. Another example of an isolation barrier is an impermeable gate or other type of openable barrier which may be opened electronically either remotely or at a designated time. Other examples of isolation barriers may be any species of valves including valve pins. Any type of barrier sufficient for isolating the reactive metal from the reaction-inducing fluid may be used provided the barrier is able to be removed when desired.

FIG. 1 is a cross-section view of an example downhole device, generally 5. Downhole device 5 comprises a reactive metal 10 isolated from a reaction-inducing fluid 15. The reactive metal 10 is isolated from the reaction-inducing fluid 15 with isolation barrier 20. In this illustrated example, the isolation barrier 20 is a rupture disc. It is to be understood that the illustrated rupture disc may be substituted for any other species of isolation barrier as would be readily apparent to one of ordinary skill in the art. The reaction-inducing fluid 15 is present in the downhole device 5 as it is brought downhole. In some alternative examples, the reaction-inducing fluid 15 may be a wellbore fluid which may enter the downhole device 5 when the downhole device 5 is downhole. A piston 25 may apply hydraulic pressure to the isolation barrier 20 via compression of the reaction-inducing fluid 15. Piston 25 may be moved to compress the reaction-inducing fluid 15 via pressure applied from a fluid to the right of the piston 25. The fluid may apply hydraulic pressure to the piston 25 after passing through check valve 30. The amount of pressure applied may be determined by the operator. For example, if isolation barrier 20 is rated for 5000 psi and the hydrostatic pressure of the reaction-inducing fluid 15 is 4000 psi, the operator may apply 1000 psi to piston 25 to rupture the isolation barrier 20. The fluid pressure applied to piston 25 may be activated by pumping a fluid from the surface or by inflow of a specific volume of a downhole fluid sufficient to apply the desired pressure. In some alternative examples, the isolation barrier 20 may be ruptured solely when the hydrostatic pressure of the reaction-inducing fluid 15 reaches a desired threshold. In said examples, a fluid or other mechanism may not be needed to apply pressure to the right of piston 25.

Figure 2:
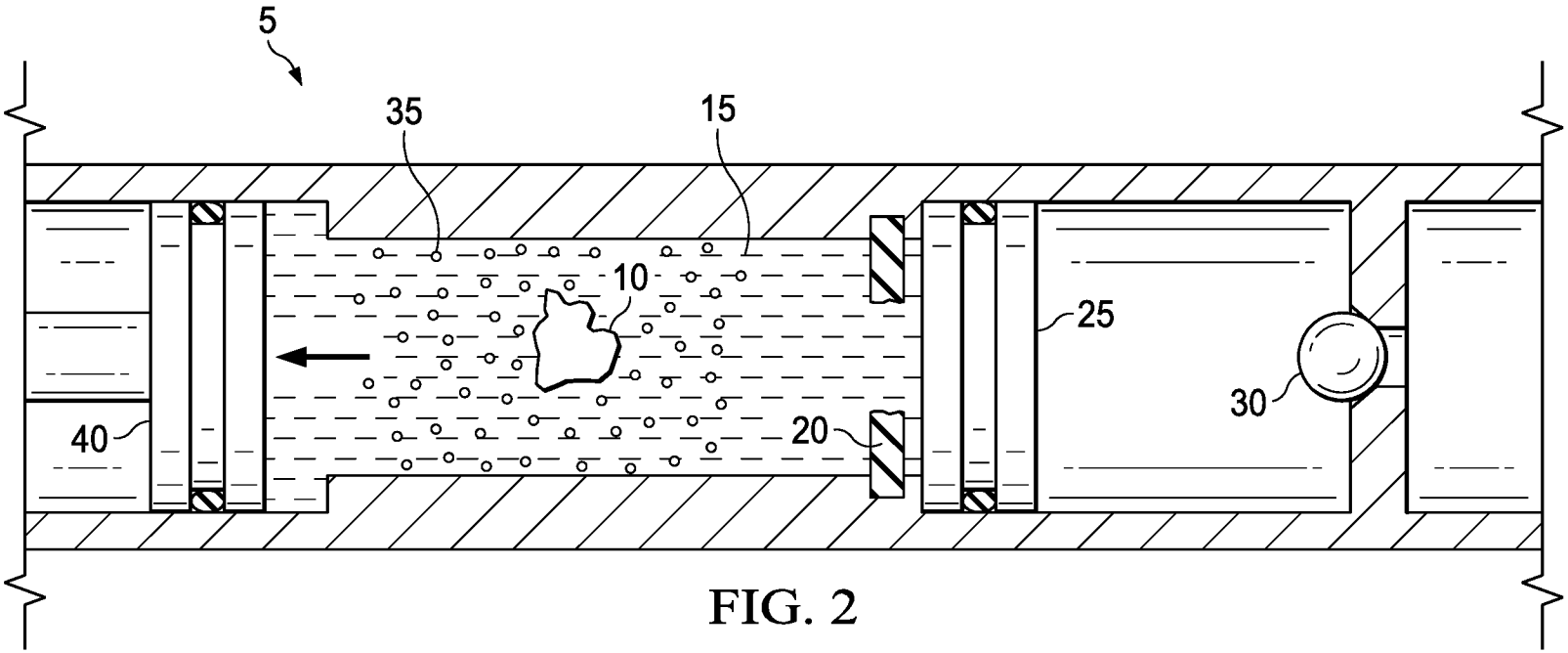
FIG. 2 is a cross-section view of the example downhole device of FIG. 1 after actuation in accordance with the examples disclosed herein.

FIG. 2 is a cross-section view of the example downhole device 5 of FIG. 1 after the isolation barrier 20 is ruptured. The rupture of the isolation barrier 20 removes the isolation of the reactive metal 10 from the reaction-inducing fluid 15. As the reaction-inducing fluid 15 contacts the reactive metal 10, hydrogen gas 35 is evolved. As the reaction proceeds, the volume of hydrogen gas 35 increases and increasing pneumatic pressure is applied to the actuating mechanism 40. In this specific example, the actuating mechanism 40 is illustrated as comprising an actuating piston and an actuating rod. It is to be understood that the illustrated actuating rod and actuating piston may be substituted for any other species of actuating mechanism as would be readily apparent to one of ordinary skill in the art. The actuating mechanism 40 may perform any number of actuating operations to actuate the downhole device 5. For example, the actuating mechanism 40 may set a packer, set or release anchor slips, open or close an inflow control device, slide a sleeve, trigger expansion of a sealing element, set plug slips, and the like. Upon application of sufficient pneumatic pressure the actuating mechanism 40 is moved to the left as illustrated. After the downhole device 5 is actuated, the hydrogen gas 35 may be released through shearing shear pins of the check valve 30, pressurized opening of a port, or through any other release mechanism. In an optional example, the check valve 30 is a barrier such as a screen that is permeable to the reaction-inducing fluid 15. In this optional example, the reactive metal 10 may produce fines upon reaction with the reaction-inducing fluid 15 and the fines may plug the screen thereby isolating the hydrogen gas 35 and allowing it to actuate the downhole device 5.

Figure 3:
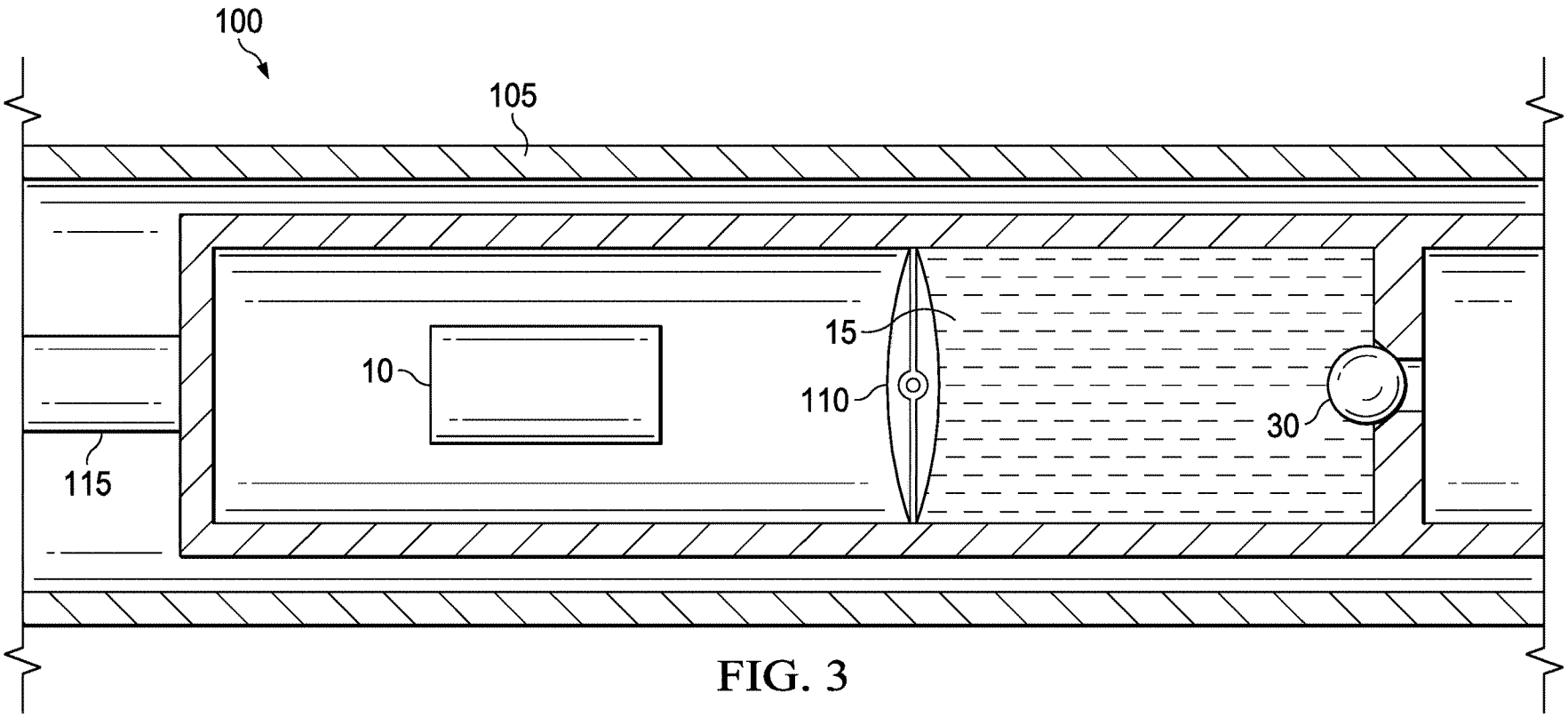
FIG. 3 is a cross-section view of another example downhole device in accordance with the examples disclosed herein.

FIG. 3 is a cross-section view of an example downhole device, generally 100. In the illustrated example, downhole device 100 is a sliding sleeve disposed within a conduit 105. Downhole device 100 comprises a reactive metal 10 isolated from a reaction-inducing fluid 15. The reactive metal 10 is isolated from the reaction-inducing fluid 15 with isolation barrier 110. In this illustrated example, the isolation barrier 110 is an electronically controlled gate that rotates or has a portion that rotates, such as the illustrated portion. It is to be understood that the illustrated electronically controlled gate may be substituted for any other species of isolation barrier as would be readily apparent to one of ordinary skill in the art. The reaction-inducing fluid 15 is present in the downhole device 100 as it is brought downhole. In some alternative examples, the reaction-inducing fluid 15 may be a wellbore fluid which may enter the downhole device 100 when the downhole device 100 is downhole. Additional fluid may be introduced through check valve 30 if necessary. The additional fluid may be introduced by pumping a fluid from the surface or by inflow of a specific volume of a downhole fluid. When ready for use, the isolation barrier 110 may be triggered to rotate to an open orientation either from a control signal from the surface or a preprogrammed signal set to a desired time.

Figure 4:
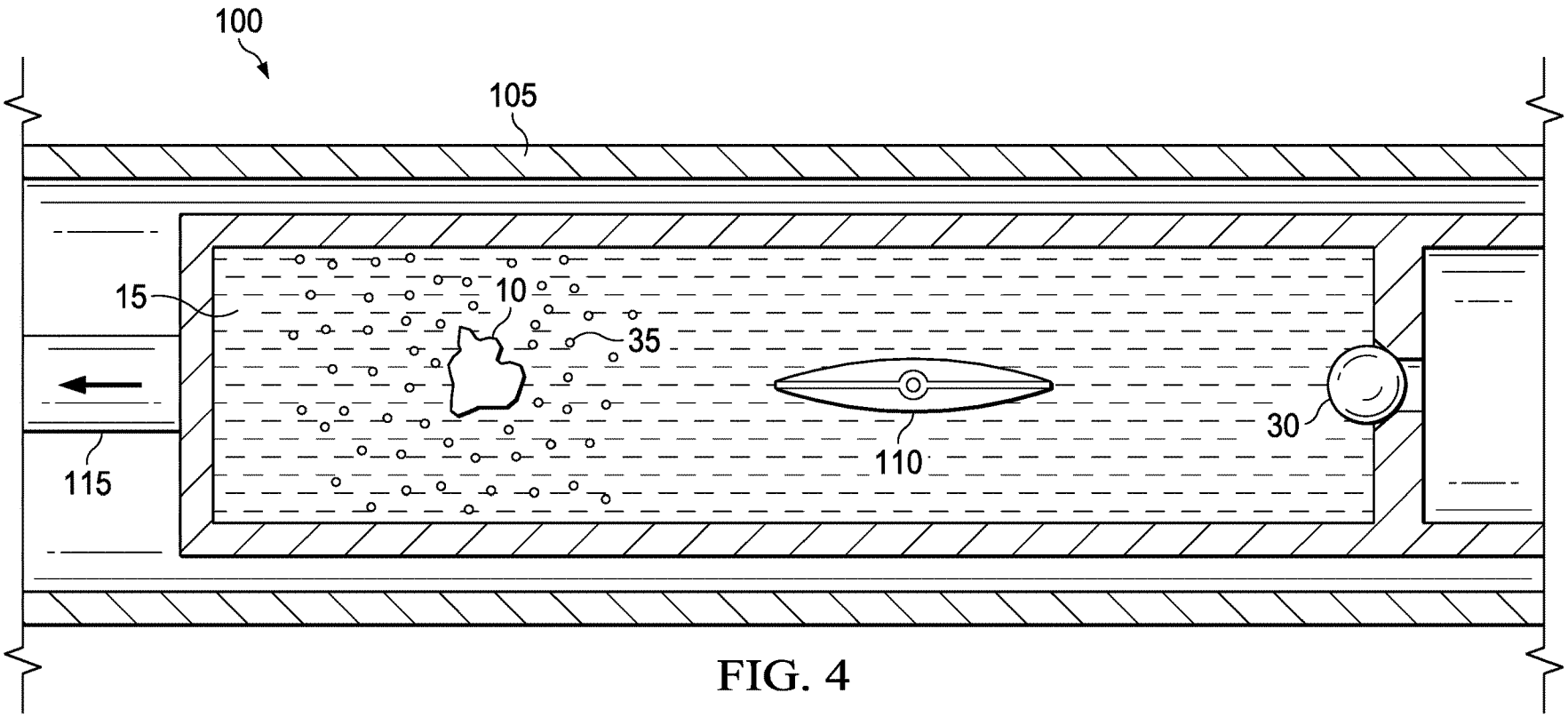
FIG. 4 is a cross-section view of the example downhole device of FIG. 3 after actuation in accordance with the examples disclosed herein.

FIG. 4 is a cross-section view of the example downhole device 100 of FIG. 3 after the isolation barrier 110 has been triggered to rotate to an open position. The rotation of the isolation barrier 110 removes the isolation of the reactive metal 10 from the reaction-inducing fluid 15. As the reaction-inducing fluid 15 contacts the reactive metal 10, hydrogen gas 35 is evolved. As the reaction proceeds, the volume of hydrogen gas 35 increases and increasing pneumatic pressure is applied to the actuating mechanism 115. In this specific example, the actuating mechanism 115 is illustrated as a hydraulic line used to build pressure for a downstream actuation indicated by the associated arrow illustrating pressure transfer to the hydraulic line. After the downhole device 100 is actuated, the hydrogen gas 35 may be released through shearing shear pins of the check valve 30, pressurized opening of a port, or through any other release mechanism.

Figure 5:
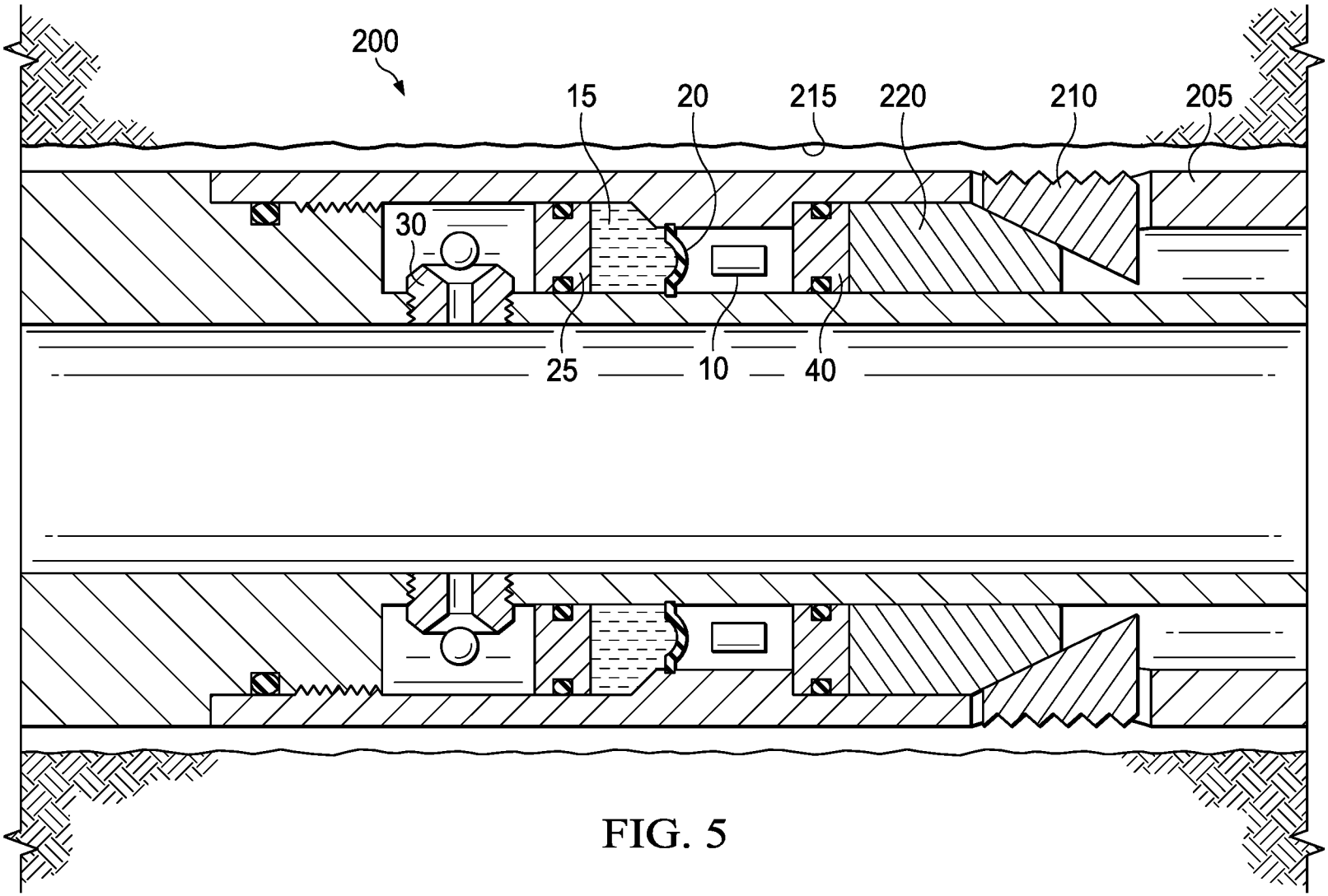
FIG. 5 is a cross-section view of another example downhole device in accordance with the examples disclosed herein.

FIG. 5 is a cross-section view of an example downhole device, generally 200. Downhole device 200 is an anchor setting device for a conduit 205. Downhole device 200 comprises a reactive metal 10 isolated from a reaction-inducing fluid 15. The reactive metal 10 is isolated from the reaction-inducing fluid 15 with isolation barrier 20. In this illustrated example, the isolation barrier 20 is a rupture disc. It is to be understood that the illustrated rupture disc may be substituted for any other species of isolation barrier as would be readily apparent to one of ordinary skill in the art. The reaction-inducing fluid 15 is present in the downhole device 200 as it is brought downhole. In some alternative examples, the reaction-inducing fluid 15 may be a wellbore fluid which may enter the downhole device 200 when the downhole device 200 is downhole. A piston 25 may apply hydraulic pressure to the isolation barrier 20 via compression of the reaction-inducing fluid 15. Piston 25 may be moved to compress the reaction-inducing fluid 15 via pressure applied from a fluid to the left of the piston 25. The fluid may apply hydraulic pressure to the piston 25 after passing through check valve 30. The amount of pressure applied may be determined by the operator. The fluid pressure applied to piston 25 may be activated by pumping a fluid from the surface or by inflow of a specific volume of a downhole fluid sufficient to apply the desired pressure. In some alternative examples, the isolation barrier 20 may be ruptured solely when the hydrostatic pressure of the reaction-inducing fluid reaches a desired threshold. In said examples, a fluid or other mechanism may not be needed to apply pressure to the right of piston 25. Downhole device 200 further comprises anchor slips 210 which anchor the downhole device 200 to a surface 215. Anchor slips 210 are forced outward to contact surface 215 via force applied from setting mechanism 220. When setting mechanism 220 is actuated, the anchor slips 210, which may be biased inward towards the axis of the downhole device 200, are forced outward to anchor the downhole device 200 to surface 215. The downhole device 200 remains anchored until the setting mechanism 220 is released.

Figure 6:
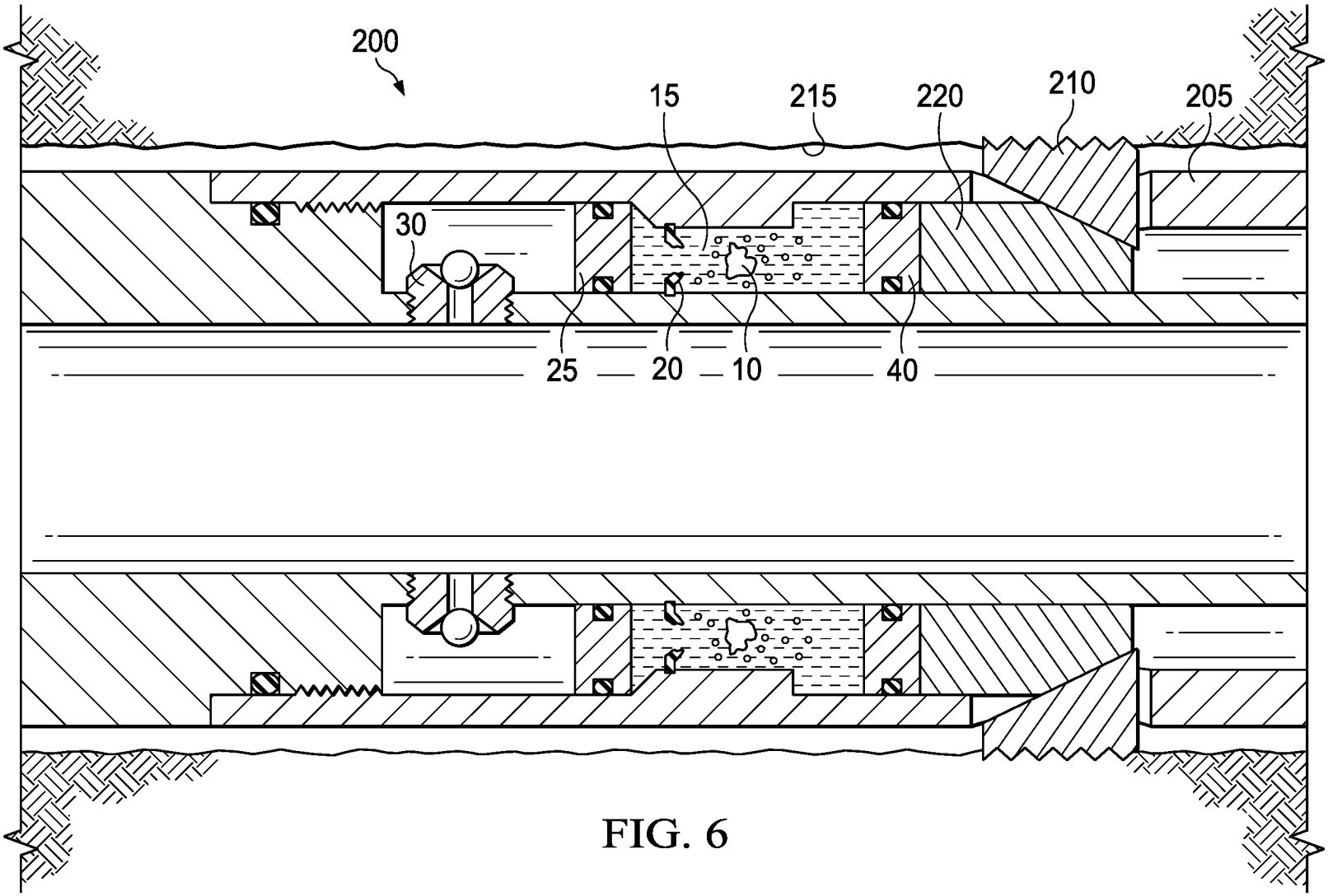
FIG. 6 is a cross-section view of the example downhole device of FIG. 5 after actuation in accordance with the examples disclosed herein.

FIG. 6 is a cross-section view of the example downhole device 200 of FIG. 5 after the isolation barrier 20 is ruptured. The rupture of the isolation barrier 20 removes the isolation of the reactive metal 10 from the reaction-inducing fluid 15. As the reaction-inducing fluid 15 contacts the reactive metal 10, hydrogen gas 35 is evolved. As the reaction proceeds, the volume of hydrogen gas 35 increases and increasing pneumatic pressure is applied to the actuating mechanism 40. In this specific example, the actuating mechanism 40 is illustrated as an actuating piston. It is to be understood that the illustrated actuating piston may be substituted for any other species of actuating mechanism as would be readily apparent to one of ordinary skill in the art. The actuating mechanism 40 may perform any number of actuating operations to actuate the downhole device 200. As actuating piston 40 moves to the left due to the increasing pneumatic pressure, the actuating piston 40 may slide the setting mechanism 220 towards the anchor slips 210. Upon application of sufficient pneumatic pressure the setting mechanism 200 is moved to the right as illustrated. Movement of the setting mechanism 220 to the right applies force to the anchor slips 210. The anchor slips 210 are then forced outward to anchor the downhole device 200 to the surface 215. After the downhole device 200 is actuated, the hydrogen gas 35 may be released through shearing shear pins of the check valve 30, pressurized opening of a port, or through any other release mechanism.

Figure 7:
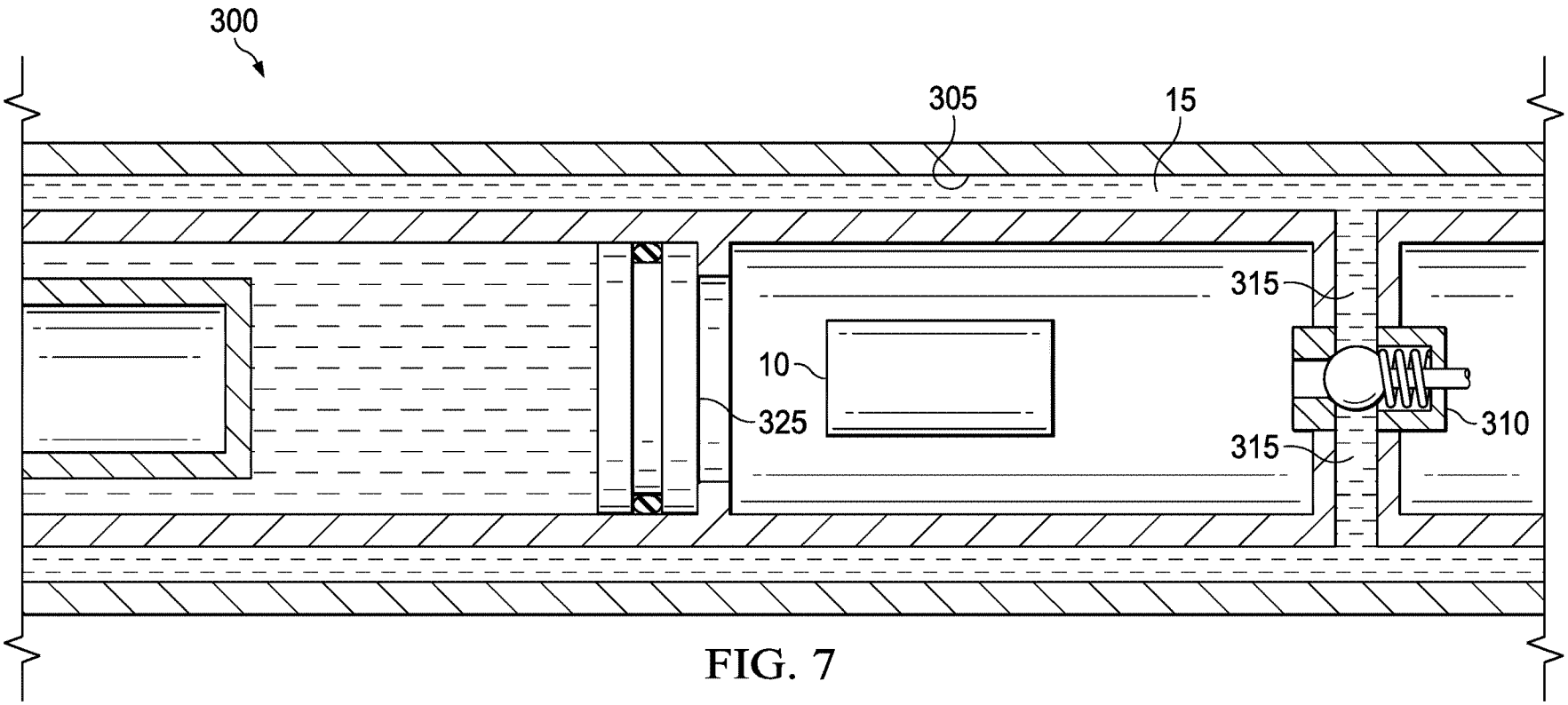
FIG. 7 is a cross-section view of another example downhole device in accordance with the examples disclosed herein.

FIG. 7 is a cross-section view of an example downhole device, generally 300. Downhole device 300 is a generic setting tool which may be used to set a packer, a sealing element, plug slips, etc. Downhole device 300 comprises a reactive metal 10 isolated from a reaction-inducing fluid 15. The reaction-inducing fluid 15 is a wellbore fluid disposed in an annulus 305 existing between the downhole device 300 and a conduit or wellbore surface. The reactive metal 10 is isolated from the reaction-inducing fluid 15 with isolation barrier 310. In this illustrated example, the isolation barrier 310 is a valve. It is to be understood that the illustrated valve may be substituted for any other species of isolation barrier as would be readily apparent to one of ordinary skill in the art. The reaction-inducing fluid 15 is not present in the downhole device 300 as it is brought downhole. In some alternative examples, the reaction-inducing fluid 15 may be present in a chamber isolated from the reactive metal 10 as the downhole device 300 is brought downhole. Ports 315 provide fluid pathways for the reaction-inducing fluid 15 to enter the downhole device 300 when the isolation barrier 310 is opened.

Figure 8:
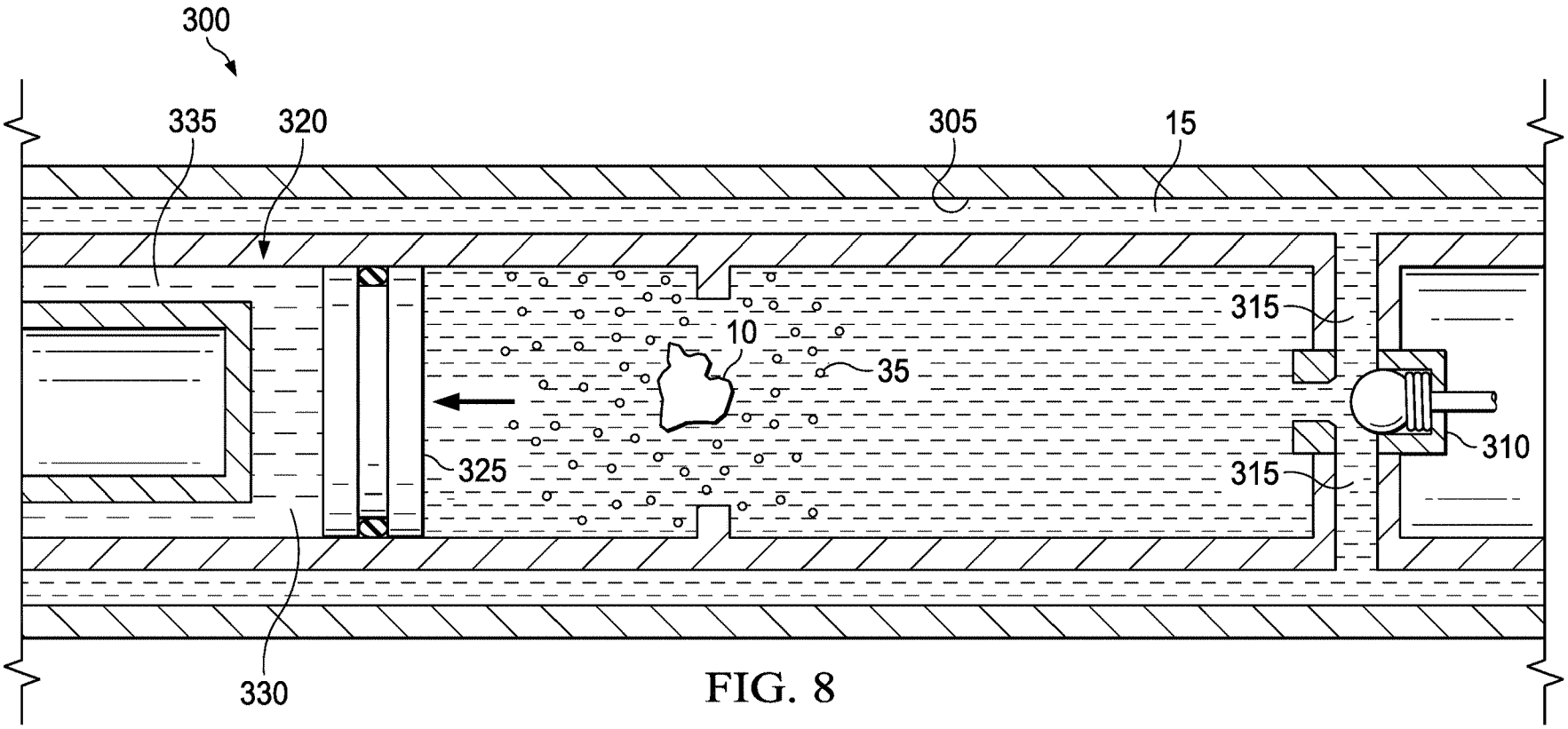
FIG. 8 is a cross-section view of the example downhole device of FIG. 7 after actuation in accordance with the examples disclosed herein.

FIG. 8 is a cross-section view of the example downhole device 300 of FIG. 7 after the isolation barrier 310 is opened. The valve isolation barrier 310 may be opened remotely or electronically programmed to open at a desired time. The opening of the isolation barrier 310 removes the isolation of the reactive metal 10 from the reaction-inducing fluid 15. As the reaction-inducing fluid 15 contacts the reactive metal 10, hydrogen gas 35 is evolved. As the reaction proceeds, the volume of hydrogen gas 35 increases and increasing pneumatic pressure is applied to the actuating mechanism 320. In this specific example, the actuating mechanism 320 comprises a setting piston 325, hydraulic fluid 330, and a setting chamber 335. It is to be understood that the illustrated actuating mechanism 320 may be substituted for any other species of actuating mechanism as would be readily apparent to one of ordinary skill in the art. Upon application of sufficient pneumatic pressure, the setting piston 325 is moved to the left as illustrated. Movement of the setting piston 325 to the left forces the hydraulic fluid 330 in to the setting chamber 335. The hydraulic fluid 330 may then act to set a packer, set or release anchor slips, open or close an inflow control device, slide a sleeve, trigger expansion of a sealing element, set plug slips, and the like. After the downhole device 300 is actuated, the hydrogen gas 35 may be released through any release mechanism. The isolation barrier 310 may also be configured to close at a predetermined time. For example, the isolation barrier 310 may close after a certain volume of fluid is allowed through ports 315. The isolation barrier 310 may be preprogrammed to close at a specific time or after a specific volume of fluid has flowed through, or the isolation barrier 310 may be triggered to close via a signal sent from the surface or a downhole controller apparatus.

It should be clearly understood that the examples illustrated by FIGS. 1-8 are merely general applications of the principles of this disclosure in practice, and a wide variety of other examples are possible. Therefore, the scope of this disclosure is not limited in any manner to the details of any of the FIGURES described herein.

The downhole devices may flow control devices configured to control flow into and out of a conduit. In some examples, a multiple of downhole devices may be used to control flow into and out of a conduit. In some examples, the multiple downhole devices may be actuated simultaneously. In other examples, the actuation of the multiple downhole devices may be staggered. Different types of downhole devices may be used in the wellbore. For example, a sliding sleeve downhole device and a packer setting tool device may be used in the same wellbore.

It is also to be recognized that the downhole devices may also directly or indirectly affect the various downhole equipment and tools that may come into contact with the downhole devices during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are methods for actuating a downhole device in a wellbore in accordance with the disclosure and the illustrated FIGURES. An example method comprises positioning a downhole device in a wellbore, the downhole device comprising a reactive metal and a reaction-inducing fluid; wherein the reaction-inducing fluid is isolated from the reactive metal. The method further comprises removing the isolation of the reactive metal such that it reacts with the reaction-inducing fluid to generate a hydrogen gas, and actuating the downhole device with the hydrogen gas.

Additionally or alternatively, the method may include one or more of the following features individually or in combination. The downhole device may be a setting tool, an inflow control device, a gravel pack bypass, a sliding sleeve, a packer, an annular casing packer, a frac plug, a bridge plug, or a tubing anchor. The removal of the isolation of the reactive metal may comprise rupturing a rupture disc, opening a gate, opening a valve, degrading a coating on the reactive metal, or any combination thereof. The actuation of the downhole device may comprise applying pneumatic pressure to a surface. The surface may be a surface of a piston. The reactive metal may comprise a metal selected from the group consisting of magnesium, calcium, aluminum, zinc, iron, potassium, sodium, and any combination thereof. The reactive metal may comprise a metal alloy selected from the group consisting of magnesium-zinc, magnesium-aluminum, or calcium-magnesium and any combination thereof. The reaction-inducing fluid may comprise an aqueous fluid. The aqueous fluid may further comprise an acid. The acid may be selected from the group consisting of citric acid, hydrochloric acid, succinic acid, sulfamic acid, adipic acid, lactic acid, and any combination thereof.

Provided are downhole devices for a wellbore in accordance with the disclosure and the illustrated FIGURES. An example downhole device comprises a reactive metal, a reaction-inducing fluid, and a check valve.

Additionally or alternatively, the downhole device may include one or more of the following features individually or in combination. The downhole device may be a setting tool, an inflow control device, a gravel pack bypass, a sliding sleeve, a packer, an annular casing packer, a frac plug, a bridge plug, or a tubing anchor. The downhole device may further comprise an isolation barrier comprising a rupture disc, a gate, a valve, a coating on the reactive metal, or any combination thereof. The reactive metal may comprise a metal selected from the group consisting of magnesium, calcium, aluminum, zinc, iron, potassium, sodium, and any combination thereof. The reactive metal may comprise a metal alloy selected from the group consisting of magnesium-zinc, magnesium-aluminum, or calcium-magnesium and any combination thereof. The reaction-inducing fluid may comprise an aqueous fluid. The aqueous fluid may further comprise an acid. The acid may be selected from the group consisting of citric acid, hydrochloric acid, succinic acid, sulfamic acid, adipic acid, lactic acid, and any combination thereof.

Provided are systems for actuating a downhole device in a wellbore in accordance with the disclosure and the illustrated FIGURES. An example system comprises a reactive metal, a reaction-inducing fluid, and an isolation barrier isolating the reactive metal from the reaction-inducing fluid. The system further comprises a conduit disposed in the wellbore; wherein the downhole device is configured to control flow into and out of the conduit.

Additionally or alternatively, the system may include one or more of the following features individually or in combination. The downhole device may be a setting tool, an inflow control device, a gravel pack bypass, a sliding sleeve, a packer, an annular casing packer, a frac plug, a bridge plug, or a tubing anchor. The downhole device may further comprise an isolation barrier comprising a rupture disc, a gate, a valve, a coating on the reactive metal, or any combination thereof. The reactive metal may comprise a metal selected from the group consisting of magnesium, calcium, aluminum, zinc, iron, potassium, sodium, and any combination thereof. The reactive metal may comprise a metal alloy selected from the group consisting of magnesium-zinc, magnesium-aluminum, or calcium-magnesium and any combination thereof. The reaction-inducing fluid may comprise an aqueous fluid. The aqueous fluid may further comprise an acid. The acid may be selected from the group consisting of citric acid, hydrochloric acid, succinic acid, sulfamic acid, adipic acid, lactic acid, and any combination thereof.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for actuating a downhole device, the method comprising:

positioning a downhole device in a wellbore comprising a wellbore fluid, the downhole device comprising a reactive metal and a reaction-inducing fluid; wherein the reactive metal is alloyed with a dopant metal selected from the group consisting of nickel, iron, carbon, titanium, gallium, mercury, cobalt, iridium, gold, palladium, or any combination thereof; wherein the reaction-inducing fluid is isolated from the reactive metal by an isolation barrier; wherein the reaction-inducing fluid is present in the downhole device as the downhole device is brought downhole; wherein the reaction-inducing fluid is isolated from the wellbore fluid; wherein the downhole device is a setting tool, an inflow control device, a gravel pack bypass, a sliding sleeve, a packer, an annular casing packer, a frac plug, a bridge plug, or a tubing anchor;

applying pressure to a moveable barrier separating the reaction-inducing fluid from the applied pressure;

compressing the reaction-inducing fluid; wherein the compressed reaction-inducing fluid applies pressure to the isolation barrier; wherein the moveable barrier and isolation barrier are distinct barriers separated by the reaction-inducing fluid;

removing the isolation provided by the isolation barrier with the compressed reaction-inducing fluid such that the reaction-inducing fluid flows past the open isolation barrier and then contacts the reactive metal to induce a reaction with the reaction-inducing fluid thereby generating a hydrogen gas, then actuating the downhole device with the hydrogen gas.

2. The method of claim 1, wherein the removing the isolation barrier comprises rupturing a rupture disc, opening a gate, opening a valve, degrading a coating on the reactive metal, or any combination thereof.

3. The method of claim 1, wherein the actuating the downhole device comprises applying pneumatic pressure to a surface of an actuating mechanism.

4. The method of claim 3, wherein the surface is a surface of a piston.

5. The method of claim 1, wherein the reactive metal comprises a metal selected from the group consisting of magnesium, calcium, aluminum, zinc, iron, potassium, sodium, and any combination thereof.

6. The method of claim 1, wherein the reactive metal comprises a metal alloy selected from the group consisting of magnesium-zinc, magnesium-aluminum, or calcium-magnesium and any combination thereof.

7. The method of claim 1, wherein the reaction-inducing fluid comprises an aqueous fluid.

8. The method of claim 7, wherein the aqueous fluid further comprises an acid.

9. The method of claim 8, wherein the acid is selected from the group consisting of citric acid, hydrochloric acid, succinic acid, sulfamic acid, adipic acid, lactic acid, and any combination thereof.

10. A downhole device for a wellbore, the downhole device comprising:

a reactive metal, wherein the reactive metal is alloyed with a dopant metal selected from the group consisting of nickel, iron, carbon, titanium, gallium, mercury, cobalt, iridium, gold, palladium, or any combination thereof;

a reaction-inducing fluid stored in a chamber of the downhole device; wherein the reaction-inducing fluid is isolated from the reactive metal by an isolation barrier, wherein the reaction-inducing fluid is isolated from a wellbore fluid after the downhole device is introduced into the wellbore;

an actuating mechanism comprising a setting piston, hydraulic fluid, and a setting chamber;

wherein reaction of the reaction-inducing fluid and the reactive metal releases hydrogen gas which translates the setting piston thereby forcing the hydraulic fluid into the setting chamber; and a check valve;

a moveable barrier separating the reaction-inducing fluid from a pressure source; wherein pressure from the pressure source is applied to the moveable barrier to move the moveable barrier to compress the reaction-inducing fluid; wherein the compressed reaction-inducing fluid applies pressure to the isolation barrier to remove the isolation provided by isolation barrier with the compressed reaction-inducing fluid such that the reaction-inducing fluid flows past the open isolation barrier and then contacts the reactive metal to generate the hydrogen gas; wherein the moveable barrier and isolation barrier are distinct barriers separated by the reaction-inducing fluid;

wherein after actuation, the hydrogen gas is released through shearing shear pins of the check valve or the pressurized opening of a port in the chamber; and wherein the downhole device is a setting tool, an inflow control device, a gravel pack bypass, a sliding sleeve, a packer, an annular casing packer, a frac plug, a bridge plug, or a tubing anchor.

11. The downhole device of claim 10, wherein the isolation barrier comprises a rupture disc, a gate, a valve, a coating on the reactive metal, or any combination thereof.

12. The downhole device of claim 10, wherein the reactive metal comprises a metal selected from the group consisting of magnesium, calcium, aluminum, zinc, iron, potassium, sodium, and any combination thereof.

13. The downhole device of claim 10, wherein the reactive metal comprises a metal alloy selected from the group consisting of magnesium-zinc, magnesium-aluminum, or calcium-magnesium and any combination thereof.

14. The downhole device of claim 10, wherein the reaction-inducing fluid comprises an aqueous fluid.

15. The downhole device of claim 14, wherein the aqueous fluid further comprises an acid.

16. A system for isolating flow in a wellbore, the system comprising:

a downhole device comprising:

a reactive metal, wherein the reactive metal is alloyed with a dopant metal selected from the group consisting of nickel, iron, carbon, titanium, gallium, mercury, cobalt, iridium, gold, palladium, or any combination thereof;

a reaction-inducing fluid stored in a chamber of the downhole device; wherein the reaction-inducing fluid is isolated from the reactive metal by an isolation barrier, wherein the reaction-inducing fluid is isolated from a wellbore fluid after the downhole device is introduced into the wellbore;

the isolation barrier;

an actuating mechanism comprising a setting piston, hydraulic fluid, and a setting chamber; wherein reaction of the reaction-inducing fluid and the reactive metal releases hydrogen gas which translates the setting piston thereby forcing the hydraulic fluid into the setting chamber; wherein after actuation, the hydrogen gas is released through shearing shear pins of a check valve or the pressurized opening of a port in the chamber; wherein the downhole device is a setting tool, an inflow control device, a gravel pack bypass, a sliding sleeve, a packer, an annular casing packer, a frac plug, a bridge plug, or a tubing anchor; and a conduit disposed in the wellbore; wherein the downhole device is configured to control flow into and out of the conduit; and a moveable barrier separating the reaction-inducing fluid from a pressure source; wherein pressure from the pressure source is applied to the moveable barrier to move the moveable barrier to compress the reaction-inducing fluid; wherein the compressed reaction-inducing fluid applies pressure to the isolation barrier to remove the isolation provided by the isolation barrier with the compressed reaction-inducing fluid such that the reaction-inducing fluid flows past the open isolation barrier and then contacts the reactive metal to generate the hydrogen gas; wherein the moveable barrier and isolation barrier are distinct barriers separated by the reaction-inducing fluid.

17. The system of claim 16, wherein the reactive metal comprises a metal selected from the group consisting of magnesium, calcium, aluminum, zinc, iron, potassium, sodium, and any combination thereof.

18. The system of claim 16, wherein the isolation barrier comprises a rupture disc, a gate, a valve, a coating on the reactive metal, or any combination thereof.

19. The system of claim 16, wherein the reaction-inducing fluid comprises an aqueous fluid.

20. The system of claim 16, wherein the aqueous fluid further comprises an acid.

* * * * *